US006257849B1

(12) United States Patent
Wu

(10) Patent No.: US 6,257,849 B1
(45) Date of Patent: Jul. 10, 2001

(54) MANUAL AIR PUMP HAVING SELECTABLE HIGH PRESSURE AND HIGH PRESSURE MODES

(76) Inventor: Scott Wu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/547,656

(22) Filed: Apr. 12, 2000

(51) Int. Cl.[7] ..... F04B 19/00; F04B 19/01; F04B 19/02; F04B 39/10

(52) U.S. Cl. ..... 417/469; 417/487; 417/562; 417/569; 417/468; 417/238

(58) Field of Search ..... 417/469, 487, 417/559, 562, 569, 468, 238

(56) References Cited

U.S. PATENT DOCUMENTS

| | | | | |
|---|---|---|---|---|
| 624,917 | * | 3/1899 | Feeny | 417/468 |
| 799,786 | * | 9/1905 | Freel | 417/466 |
| 1,522,370 | * | 1/1925 | Jenney | 222/321.3 |
| 2,450,295 | * | 9/1948 | Parker et al. | 277/25 |
| 4,508,490 | * | 4/1985 | Ramirez et al. | 417/234 |
| 5,443,370 | * | 8/1995 | Wang | 417/238 |
| 5,655,890 | * | 8/1997 | Liao | 417/234 |
| 5,779,457 | * | 7/1998 | Chuang et al. | 417/467 |
| 5,873,705 | * | 2/1999 | Chen | 417/259 |

* cited by examiner

*Primary Examiner*—Timothy S. Thorpe
*Assistant Examiner*—Timothy P. Solak
(74) *Attorney, Agent, or Firm*—Alan Kamrath; Rider, Bennett, Egan & Arundel, LLP

(57) ABSTRACT

A manual air pump includes an outer cylinder having a chamber therein, a head provided to a second end of the outer cylinder and including an outlet passage communicated with the chamber for supplying air to an object to be inflated, and an inner cylinder reciprocatingly mounted in the outer cylinder and including a longitudinal hole. An outer piston is attached to an end of the inner cylinder to move therewith. The outer piston includes a passage that is intercommunicated between the longitudinal hole of the inner cylinder and the outlet passage of the head. A piston rod is reciprocatingly mounted in longitudinal hole of the inner cylinder. An inner piston is attached to a second end of the piston rod to move therewith. A handle is secured to a first end of the piston rod to move therewith. A switch member is rotatably mounted to the first end of the outer cylinder and around the first end of the inner cylinder. The switch member is rotatable between a first position for securing the piston rod to the inner cylinder to allow joint sliding movement of the piston rod and the inner cylinder such that reciprocating movement of the handle causes high volume/low pressure inflation and a second position for securing the inner cylinder to the outer cylinder and for disengaging the piston rod from the inner cylinder such that reciprocating movement of the handle causes low volume/high pressure inflation.

12 Claims, 11 Drawing Sheets

MANUAL AIR PUMP HAVING SELECTABLE HIGH PRESSURE AND HIGH PRESSURE MODES

BACKGROUND OF THE INVENTION

1. Field of the Invention

The present invention relates to a manual air pump for inflating, e.g., bicycle tires, and more particularly to dual-mode manual air pump that may in one mode provide a very high volume of air per stroke and in another mode provide less volume of air at high pressure.

2. Description of the Related Art

Bicycle pumps include two typical types: 1) big bore for high volume per stroke and low pressure for rapid inflation, yet high pressure operation is difficult to achieve; and 2) small bore for low volume per stroke and high pressure for inflating bicycle tires to high pressure. U.S. Pat. No. 5,443,370 issued to Wang on Aug. 22, 1995 proposes a two-cylinder manual air pump having selectable high volume and high pressure modes, wherein the pump in one mode provides a very high volume of air per pump stroke and in another mode provides less volume per stroke but enables the user to inflate to higher pressures. Nevertheless, manufacture, assembly, and use of such manual air pump are complicated and troublesome. The structure in the cylinders for air passage is too complicated. In addition, the thinner piston rod might be broken during the output stroke, as the travel for the thinner piston rod is relatively long and the piston on the thinner piston rod encounters much higher pressure when the piston approaches the inner end of the outer cylinder. Namely, the thinner piston rod tends to be broken and requires a larger force to push it. Further, the manual air pump is too long when in a fully extended status. Further, the manual air pump generates noise during inflation.

SUMMARY OF THE INVENTION

A manual air pump in accordance with the present invention comprises:

an outer cylinder comprising a chamber therein and including a first end and a second end, a head provided to the second end of the outer cylinder, the head including an outlet passage communicated with the chamber for supplying air to an object to be inflated, an inner cylinder reciprocatingly mounted in the outer cylinder and including a longitudinal hole, the inner cylinder including a first end distal to the head and a second end adjacent to the head, an outer piston being attached to the second end of the inner cylinder to move therewith, the outer piston including a passage that is intercommunicated between the longitudinal hole of the inner cylinder and the outlet passage of the head, a piston rod reciprocatingly mounted in longitudinal hole of the inner cylinder and having a first end and a second end, an inner piston being attached to the second end of the piston rod to move therewith, a handle secured to the first end of the piston rod to move therewith, and a switch member rotatably mounted to the first end of the outer cylinder and around the first end of the inner cylinder, the switch member being rotatable between a first position for securing the piston rod to the inner cylinder to allow joint sliding movement of the piston rod and the inner cylinder such that reciprocating movement of the handle causes high volume/low pressure inflation and a second position for securing the inner cylinder to the outer cylinder and for disengaging the piston rod from the inner cylinder such that reciprocating movement of the handle causes low volume/high pressure inflation.

The second end of the inner cylinder includes an inner threaded section and wherein the outer piston includes a stud for engaging with the inner threaded section of the inner cylinder.

The second end of the piston rod includes a screw hole and wherein the inner piston includes a stud for engaging with the screw hole of the piston rod.

An inner periphery defining the longitudinal hole of the inner cylinder includes a longitudinal guide strip, and the piston rod includes a longitudinal groove defined in an outer periphery thereof for receiving the longitudinal guide strip, thereby preventing relative rotational movement between the inner cylinder and the piston rod.

A cap is securely mounted to the fist end of the outer cylinder. The cap includes a longitudinal hole through which the inner cylinder extends. The cap further includes a first stop. The switch member includes a second stop and a skirt. A disc is formed between the first end of the piston rod and the handle and includes a third stop. When the switch member is in the first position, the second stop of the switch member is in overlapped relationship with the third stop of the disc, thereby allowing joint sliding movement of the piston rod and the inner cylinder, and the skirt is not in overlapped relationship with the first stop of the cap, thereby allowing joint longitudinal movement of the inner cylinder and the piston rod relative to the outer cylinder. When the switch member is in the second position, the second stop of the switch member is not in overlapped relationship with the third stop of the disc, thereby allowing longitudinal sliding movement of the piston rod relative to the inner cylinder, and the skirt is in overlapped relationship with the first stop of the cap, thereby preventing longitudinal movement of the inner cylinder relative to the outer cylinder.

An inner periphery defining the longitudinal hole of the cap includes a longitudinal groove, and the inner cylinder includes a longitudinal guide strip formed on an outer periphery thereof and guided in the longitudinal groove, thereby preventing relative rotational movement between the inner cylinder and the cap.

The switch member is manually movable to a third position in which the second stop of the switch member is in overlapped relationship with the third stop of the disc and the skirt is in overlapped relationship with the first stop of the cap, thereby preventing longitudinal movement of the inner cylinder and the piston rod relative to the outer cylinder.

An engaging disc is securely mounted around the first end of the inner cylinder and received in the switch member. The engaging disc includes a recessed portion defined in a side thereof. A peripheral wall defining the recessed portion includes an inner threading for engaging with an outer threading on the first end of the inner cylinder.

In a modified embodiment of the invention, the switch member includes a groove and a second stop partially received in the groove. An elastic element is being mounted in the groove for biasing the second stop radially outward. The second stop includes an inclined surface in an underside thereof.

In another modified embodiment of the invention, the switch member includes a slot to thereby define a second stop in an end edge thereof, and the second stop includes an inclined surface in an underside thereof.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
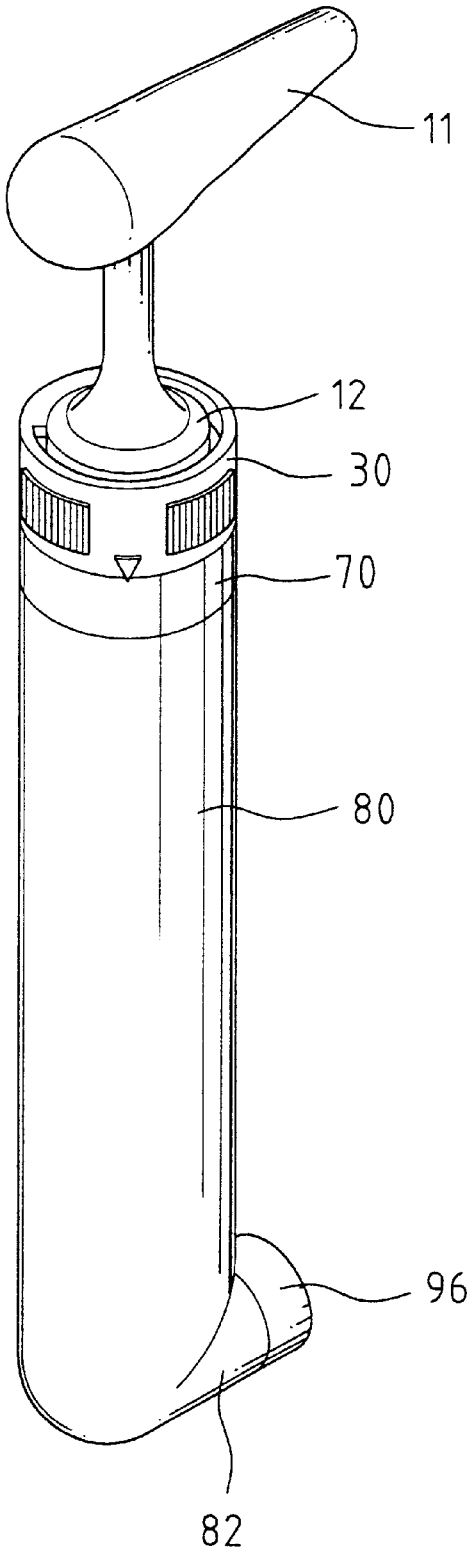
FIG. 1 is a perspective view of a manual air pump in accordance with the present invention.
Figure 2:
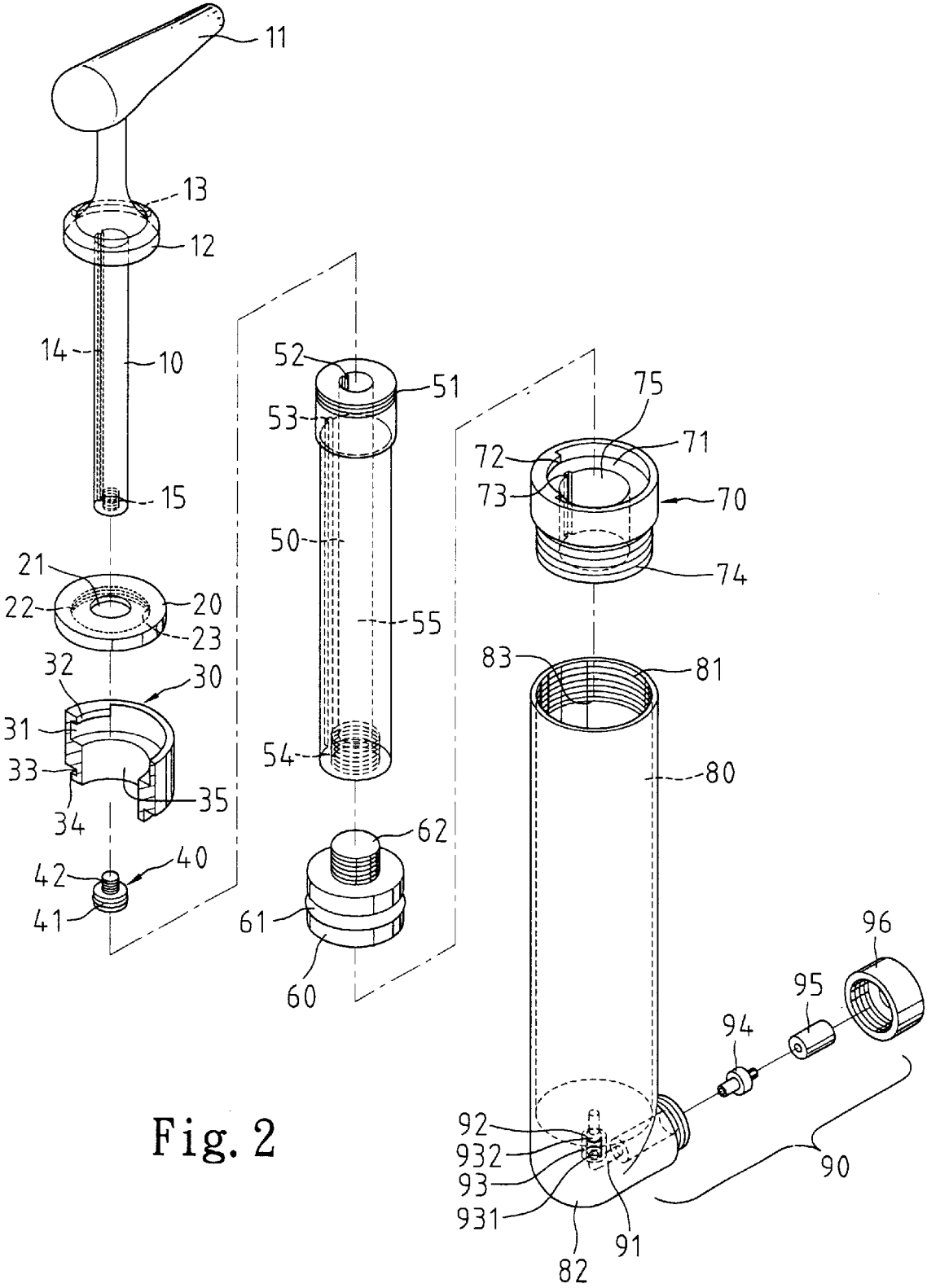
FIG. 2 is an exploded perspective view of the manual air pump in FIG. 1.
Figure 3:
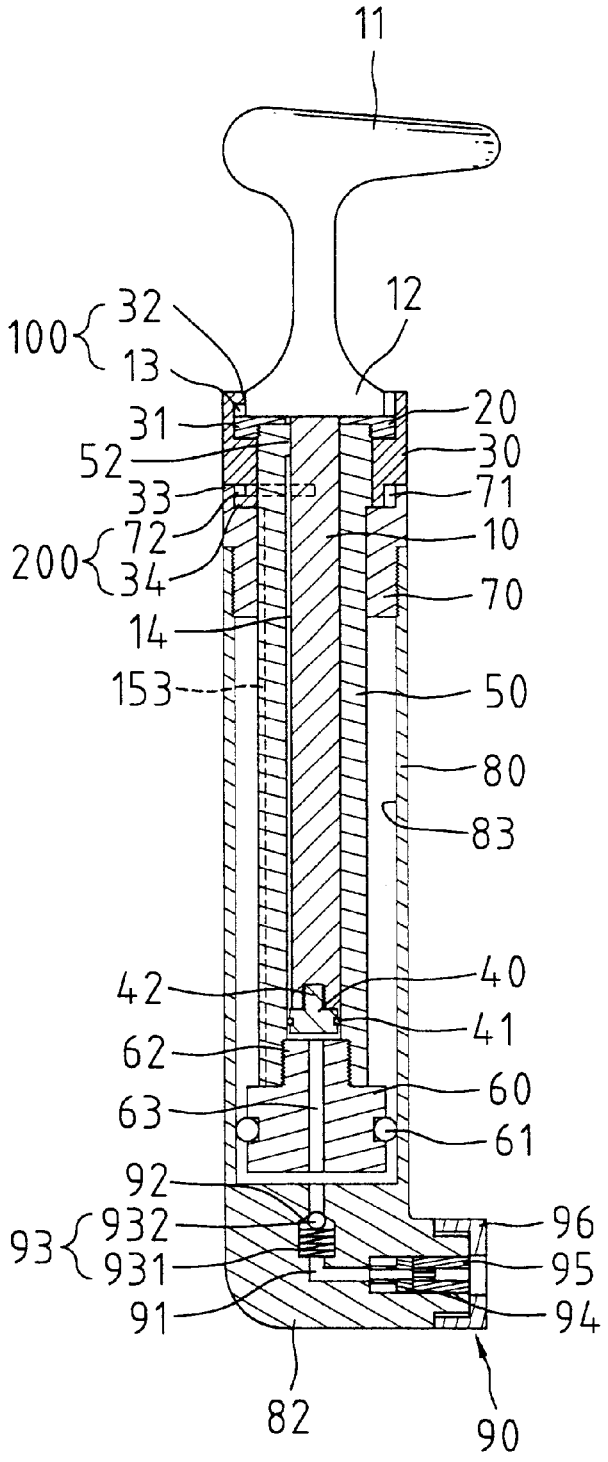
FIG. 3 is a side view, partly sectioned, of the manual air pump in accordance with the present invention, wherein the manual air pump is in a storage status.

Referring to FIGS. 1 through 3, a manual air pump in accordance with the present invention generally comprises an outer cylinder 80 including a chamber 83 therein. An inner threading 81 is provided on a first end of the outer cylinder 80 and a head 82 is formed on a other end of the outer cylinder. 80. The head 82 includes an outlet passage 91 communicated with the chamber 83 for supplying air to an object to be inflated under control of an inflation valve means 90. In this embodiment, a nozzle 94 and a nozzle plug 95 are mounted in the main passage 91, and an end cap 96 is provided to secure the nozzle 94 and nozzle plug 95 in place. A one-way valve 93 (including an elastic member 931 and a ball 932) is mounted in an enlarged section (not labeled) of the outlet passage 91 such that air is only flowable from the chamber 83 to the main passage 91.

The manual air pump further includes an inner cylinder 50 that is slidably received in the outer cylinder 80. The inner cylinder 50 includes a longitudinal hole 55. An outer threading 51 is defined in a first end of the inner cylinder 50 and an inner threaded section 54 is defined in a second end of the inner cylinder 50. An inner longitudinal guide strip 52 is formed on an inner periphery of the first end of the inner cylinder 50 and an outer longitudinal guide strip 53 is formed on an outer periphery of the inner cylinder 50. An outer piston 60 includes a stud 62 that is engaged with the inner threaded section 54 of the second end of the inner cylinder 50 to move therewith, and an 0-ring 61 is mounted around the outer piston 60 to provide a sealing effect with the inner periphery of the chamber 83 of the outer cylinder 80. The outer piston 60 includes a passage 63 that is intercommunicated between the longitudinal hole 55 and the outlet passage 91.

A piston rod 10 is reciprocatingly mounted in the inner cylinder 50 and includes a disc 12 on a first end thereof. A handle 11 extends outward from the disc 12 and beyond the outer cylinder 80 for manual operation. A sector-like stop 13 is formed on an outer periphery of the disc 12 and extends through 90°. A longitudinal guide groove 14 is defined in an outer periphery of the piston rod 10. A screw hole 15 is defined in an end wall of a second end of the piston rod 10. An inner piston 40 includes a stud 42 for engaging with the screw hole 15 of the piston rod 10. An 0-ring 41 is mounted around the inner piston 40 to provide a sealing effect with the inner periphery of the longitudinal hole 55 of the inner cylinder 50. It is noted that the outer piston 60 has an area wider than that of the inner piston 40.

An engaging disc 20 includes a through-hole 21 through which the piston rod 10 extends. The engaging disc 20 includes a side with a recessed portion 23. An inner threading 22 is defined in a peripheral wall defining the recessed portion 23.

Figure 2A:
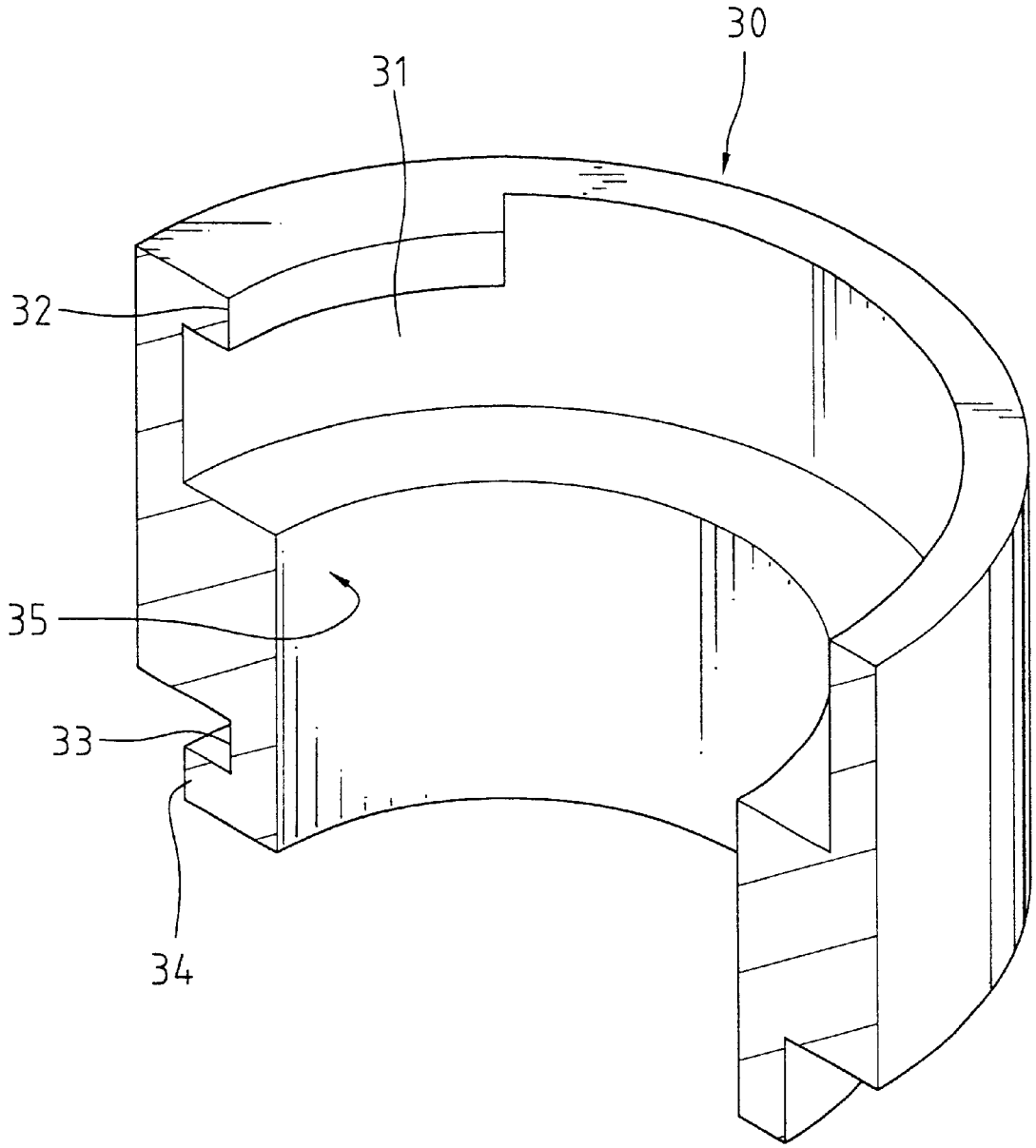
FIG. 2A is a perspective view, partly cutaway, of a switch member in FIG. 2.

Referring to FIGS. 2 and 2A, a substantially tubular switch member 30 includes a longitudinal hole 35 with an enlarged receiving section 31. The piston rod 10 extends through the longitudinal hole 35 of the switch member 30. A sector-like stop 32 is formed on an inner periphery defining the enlarged receiving section 31. As illustrated in FIG. 3, the disc 12 and its stop 13 is received in the enlarged receiving section 31. In addition, the engaging disc 20 is also received in the enlarged receiving section 31 and located below the stop 13, as shown in FIG. 3. The switch member 30 further includes an outer groove 33 adjacent to a lower end thereof that is opposite to the enlarged receiving section 31, thereby defining a skirt 34.

The outer threading 51 of the inner cylinder 50 is received in the switch member 30 and engaged with the inner threading 22 of the engaging disc 20. Thus, the inner cylinder 50 is engaged with the engaging disc 20 for preventing disengagement of the inner cylinder 50 from the switch member 30. When mounting the piston rod 10 into the inner cylinder 50, the inner guide strip 52 on the inner cylinder 50 is guided by the longitudinal groove 14 of the piston rod 10, thereby preventing relative rotation therebetween.

A cap 70 is mounted between the inner cylinder 50 and the outer cylinder 80. The cap 70 includes a longitudinal hole 75 through which the inner cylinder 50 extends. The lower end of the switch member 30 abuts against the cap 70. The cap 70 includes an enlarged receiving section 71, wherein a stop 72 projects from a peripheral wall defining the enlarged receiving section 71. The skirt 34 of the switch member 30 is received in the enlarged receiving section 71 of the cap 70, and the stop 72 of the cap 70 extends into the groove 33 of the skirt 34. The stop 72 extends through a quarter of a circle and is not in overlapped relationship with the stop 13 of the disc 12. In addition, the cap 70 includes a longitudinal groove 73 for receiving and guiding the outer guide strip 53 of the inner cylinder 50 when mounting the inner cylinder 50 into the outer cylinder 80, thereby preventing relative rotation therebetween. The cap 70 further includes an outer threading 74 for engaging with the inner threading 81 of the outer cylinder 80.

Figure 4:
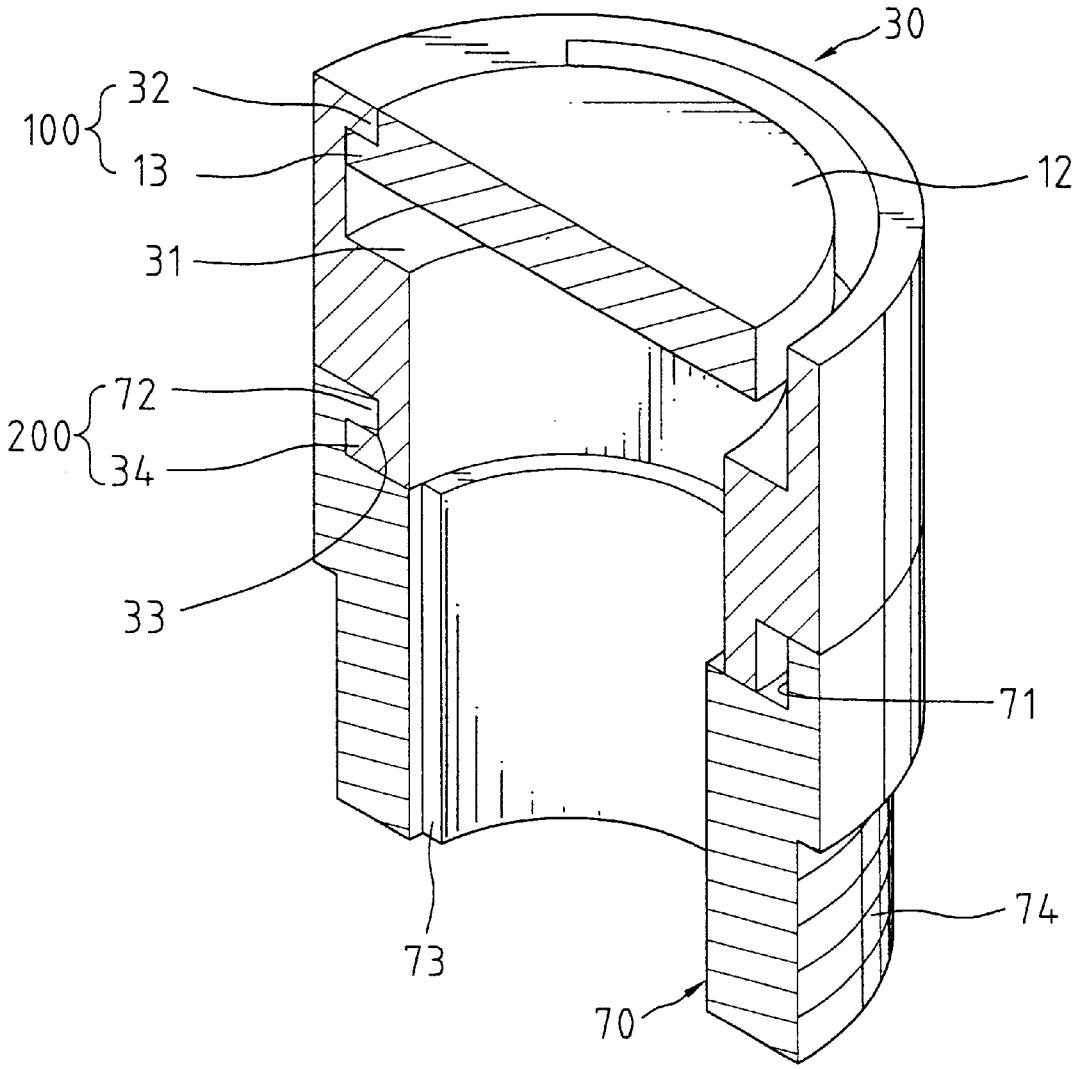
FIG. 4 is a perspective view, partly cutaway, of the switch member and a cap in FIG. 3.

The manual air pump in FIG. 3 is in a storage status, and FIG. 4 is a cutaway perspective view of the switch member 30 and the cap 70. The stop 13 of the disc 12 and the stop 72 of the cap 70 are not overlapped with each other. As illustrated in FIG. 4, when a user turns the switch member 30 to make the stop 32 of the switch member 30 move to a place above the stop 13 of the disc 12, only a right half portion of the stop 32 is above the stop 13 of the disc 13. Thus, the piston rod 10 is not movable in the inner cylinder 50 along the longitudinal direction. Namely, the stop 32 of the switch member 30 and the stop 13 of the disc 12 together form a locking mechanism 100 for locking the piston rod 10 with the inner cylinder 50. In addition, during rotation of the switch member 30, the skirt 34 of the switch member 30 is moved to a place below the stop 72 of the cap 70. Only a left portion of the skirt 34 is below the stop 72 of the cap 70 such that the inner cylinder 50 can not move longitudinally in the outer cylinder 80. Namely, the skirt 34 of the switch member 30 and the stop 72 of the cap 70 together define a locking mechanism to locking the inner cylinder 50 and the outer cylinder 80 in place. Accordingly, the manual air pump is in a storage status not ready for inflation operation.

Figure 5:
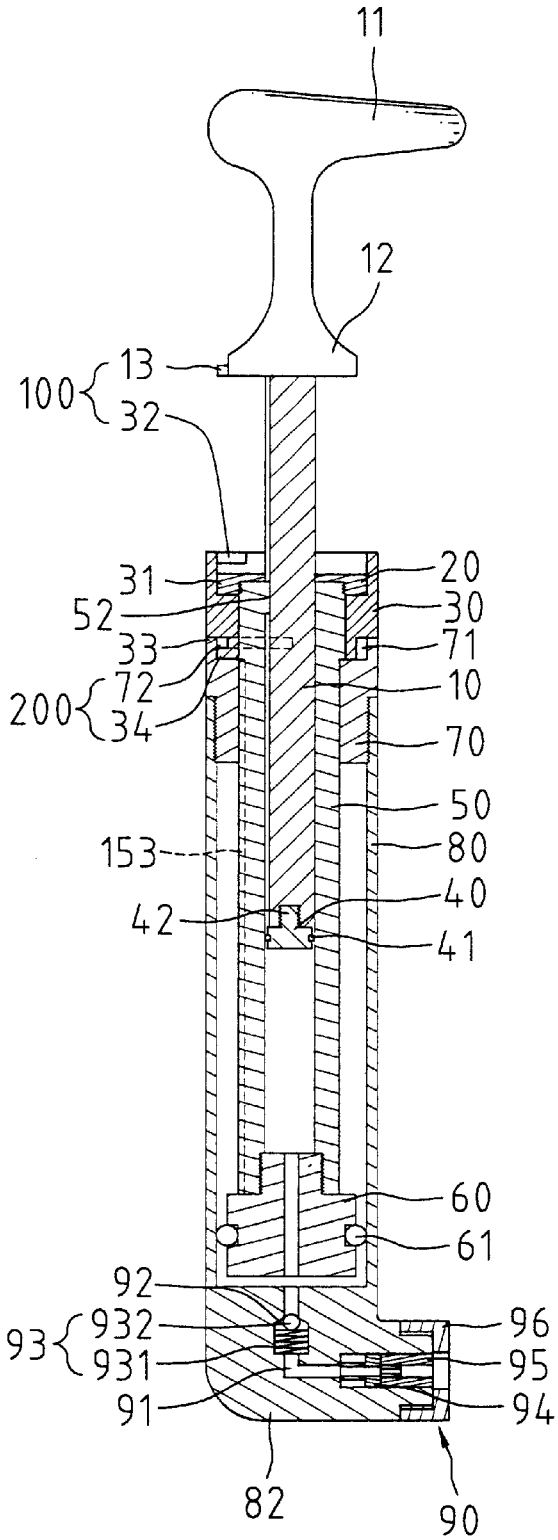
FIG. 5 is a sectional view similar to FIG. 3, wherein the manual air pump is in a status for high-pressure pumping.
Figure 6:
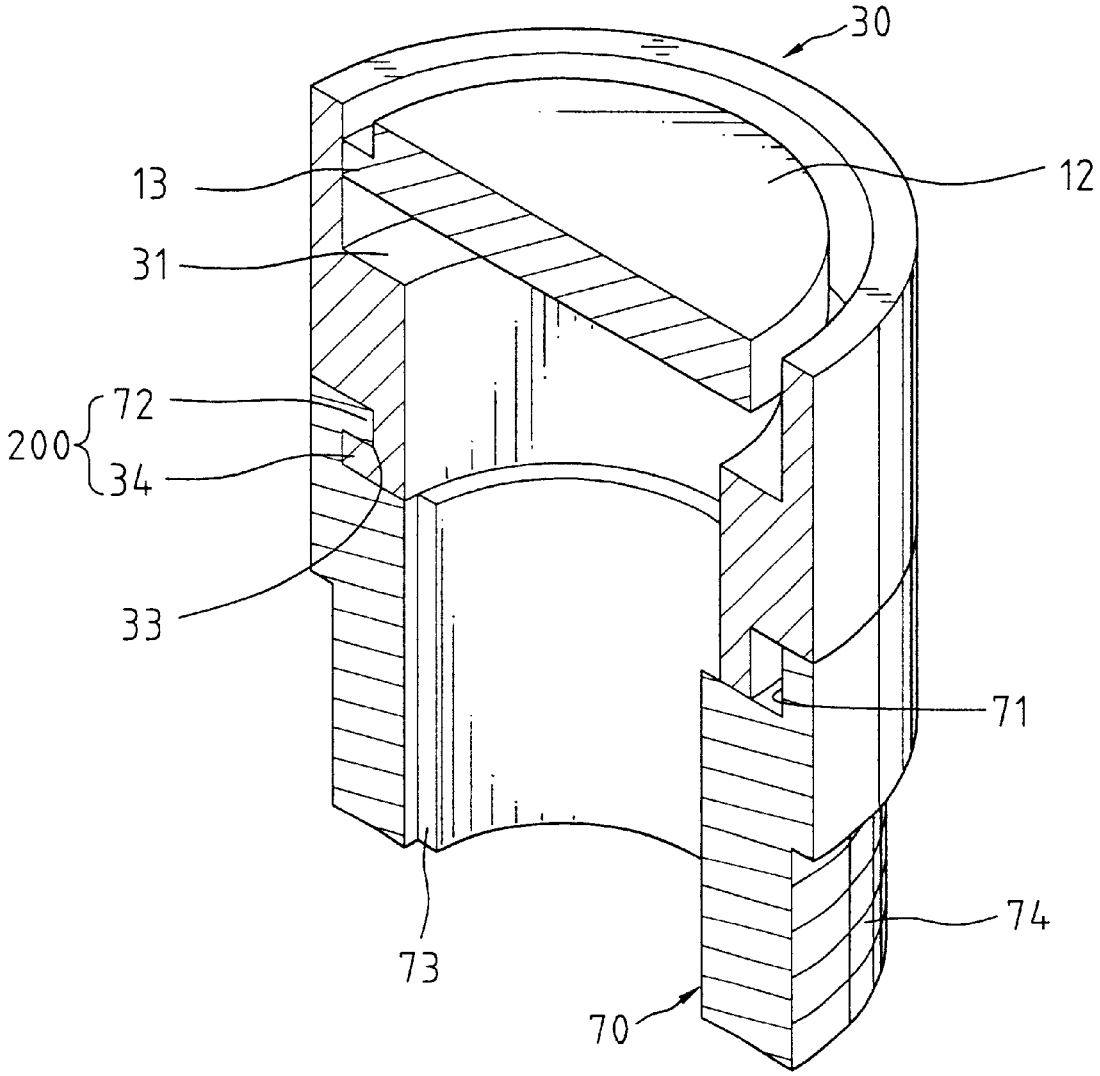
FIG. 6 is a perspective view, partly cutaway, of the switch member and the cap in FIG. 5.

Referring to FIGS. 5 and 6, when the user intends to proceed with high pressure/high volume inflation, the inner cylinder 50 is fixed in place and the piston rod 10 is reciprocatingly moved in the inner cylinder 50. As illustrated in FIG. 6, the user turns the switch member 30 to move the stop 32 of the switch member 30 away from the stop 13 of the disc 12. Namely, the stop 32 of the switch member 30 is not above the stop 13 of the disc 12, thereby allowing the piston rod 10 to move longitudinally relative to the inner cylinder 50. In addition, during rotation of the switch member 30, the skirt 34 is moved to be thoroughly below the stop 72 of the cap 70 such that the inner cylinder 50 can not move longitudinally relative to the outer cylinder 80. Namely, the inner cylinder 50 and the outer cylinder 80 are locked in place by the locking mechanism constituted by the skirt 34 of the switch member 30 and the stop 72 of the cap 70. Accordingly, the manual air pump is in a status for proceeding with high pressure/high volume inflation, as the area of the inner piston 40 is small. High-pressure air is outputted to an object to be inflated via the passage 63 in the piston 60 and the outlet passage 91.

Figure 7:
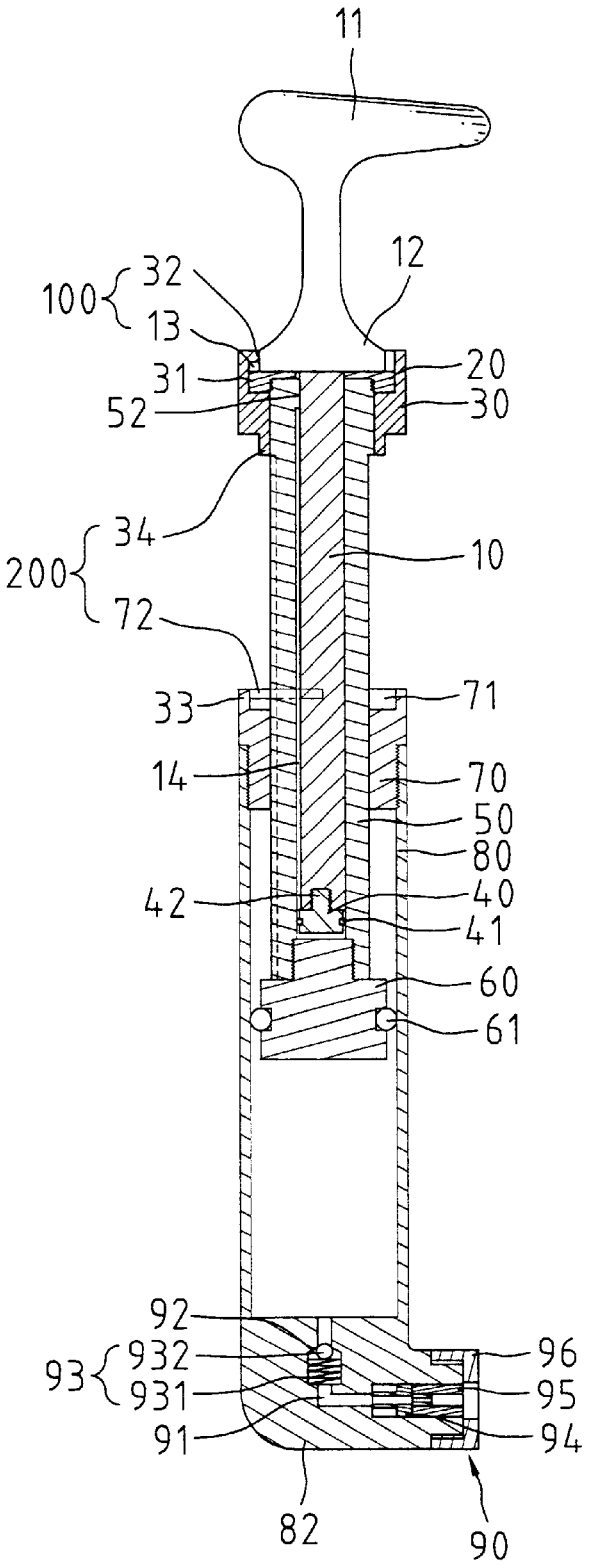
FIG. 7 is a sectional view similar to FIG. 5, wherein the manual air pump is in a status for high-volume pumping.
Figure 8:
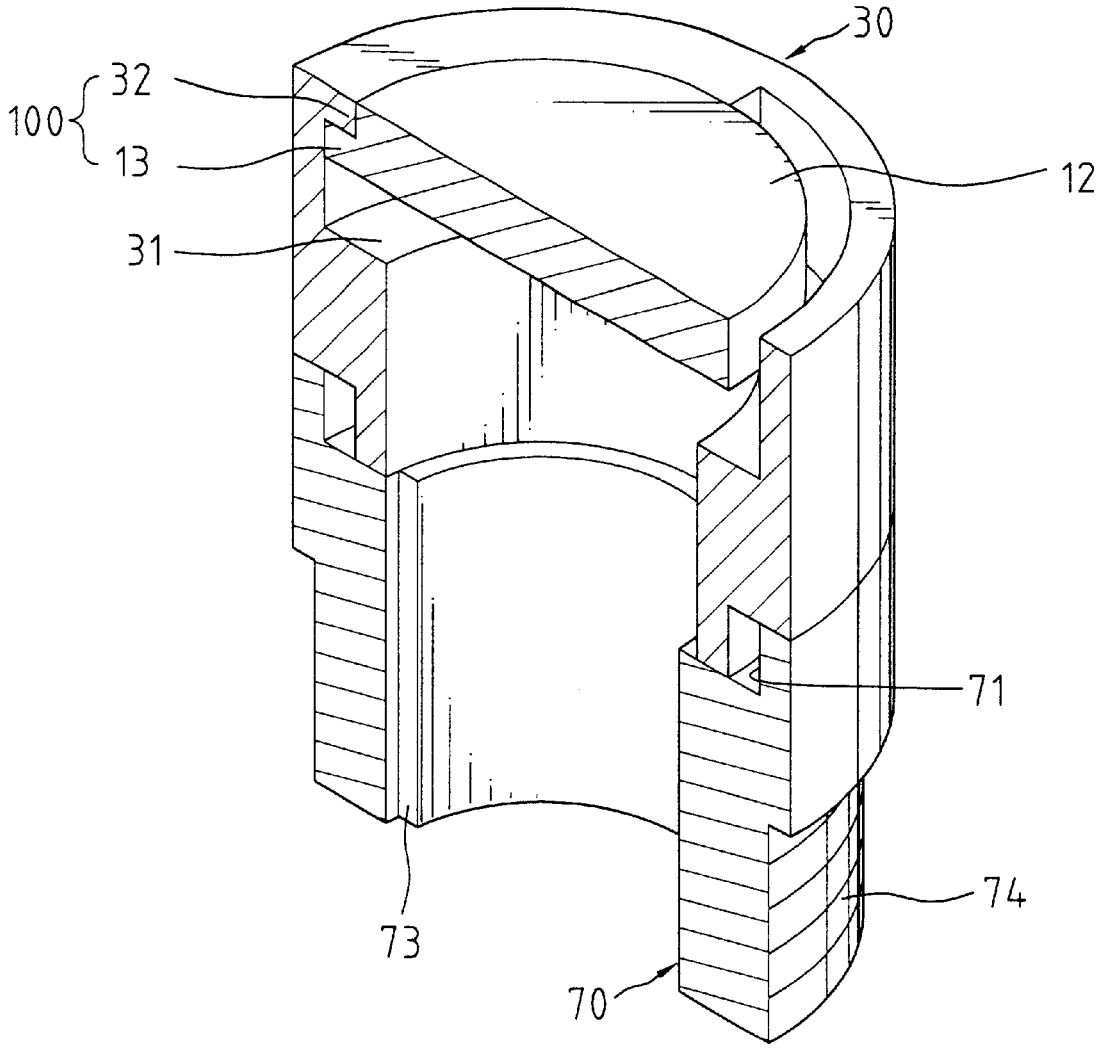
FIG. 8 is perspective view, partly cutaway, of the switch member and the cap in FIG. 7.

Referring to FIGS. 7 and 8, when the user intends to proceed with high volume/low pressure inflation, the inner cylinder 50 and the piston rod 10 are connected together so as to move reciprocatingly relative to the outer cylinder 80. As illustrated in FIG. 8, the user turns the switch member 30 to move the stop 32 of the switch member 30 to a place thoroughly above the stop 13 of the disc 12, thereby engaging the piston rod 10 and the inner cylinder 50 together by the locking mechanism 100 constituted by the stop 32 of the switch member 30 and the stop 13 of the disc 12. In addition, during rotation of the switch member 30, the skirt 34 is moved away from and thus not in overlapped relationship with the stop 72 of the cap 70 such that the inner cylinder 50 and the piston rod 10 can move longitudinally relative to the outer cylinder 80. Accordingly, the manual air pump is in a status for proceeding with high volume/low pressure inflation, as the area of the outer piston 60 is small. High-volume air is outputted to an object to be inflated via the outlet passage 91.

Figure 9:
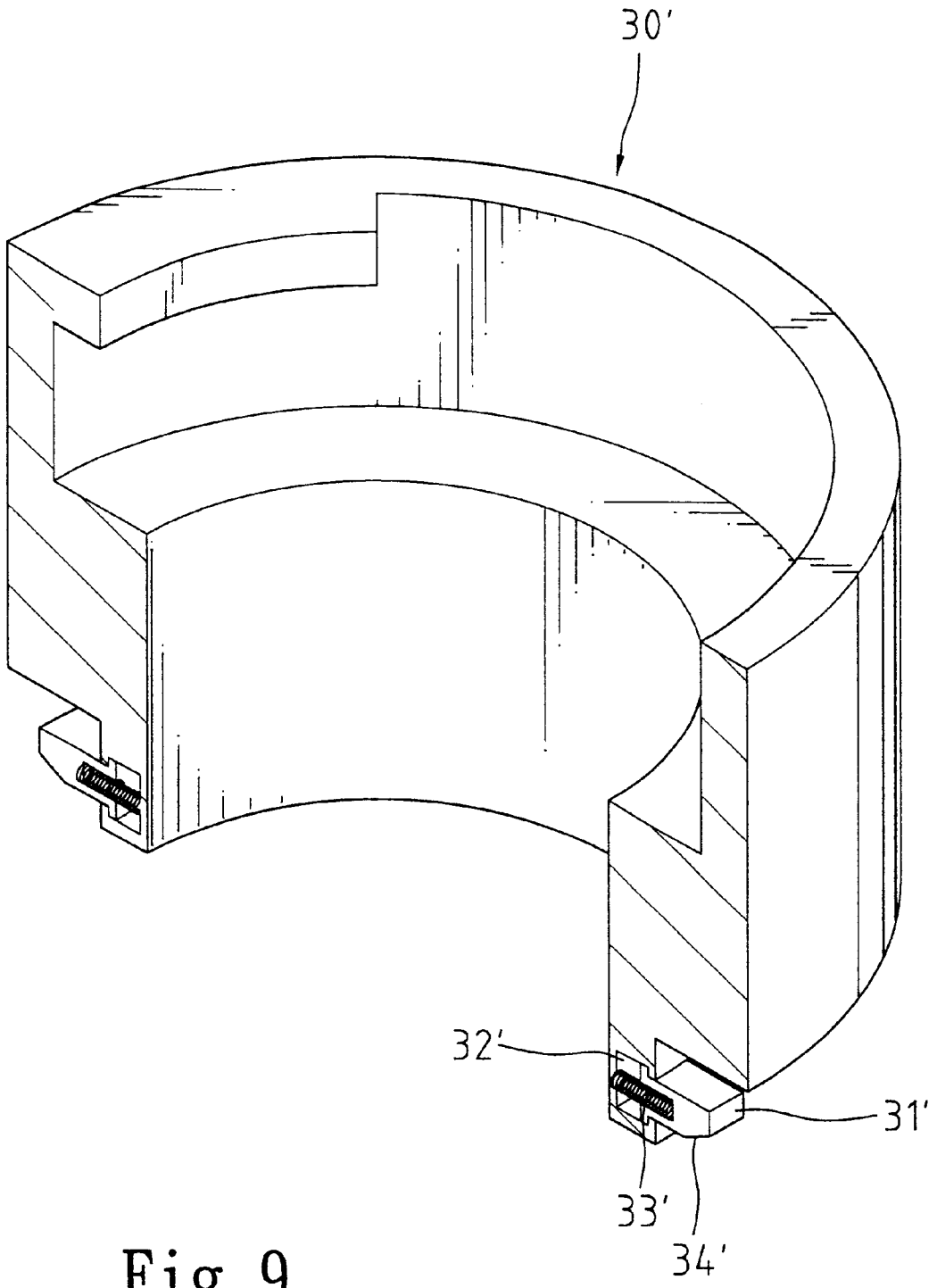
FIG. 9 is a perspective view, partly cutaway, of another embodiment of the switch member.

FIG. 9 illustrates a modified embodiment of the switch member of the invention, wherein the switch member (now designated by 30') includes two diametrically formed stops 31'. The lower end of the switch member 30' includes two diametrically disposed grooves 32' each for receiving an elastic member 33' and an associated stop 31'. Each stop 31' includes an inclined surface 34' in an underside thereof. When the switch member 30' is to be retracted into the outer cylinder 80, the stop 72 of the cap 70 bears against the inclined surface 34' when the stop 31' comes in contact with the stop 72. The stop 31' is thus retracted radially inward. Namely, the switch member 30' can be retracted into the outer cylinder 80 without moving to a specific angular position.

Figure 10:
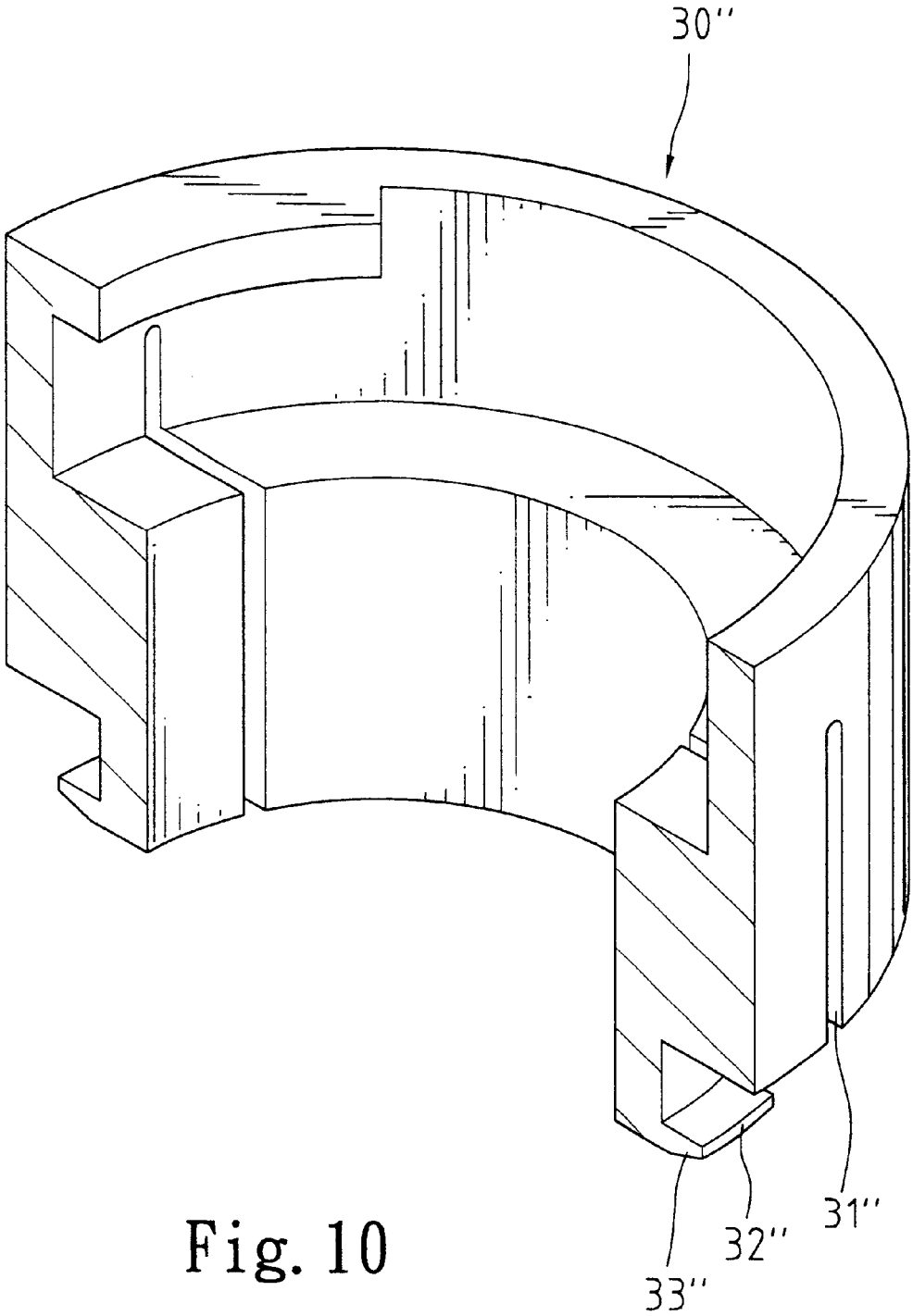
FIG. 10 is a perspective view, partly cutaway, of a further embodiment of the switch member.

FIG. 10 illustrates a further modified embodiment of the switch member (now designated by 30") of the invention. The switch member 30" includes a slot 31" to thereby form a resilient stop 32". The stop 32" includes an inclined surface 33" in an underside thereof. When the switch member 30" is to be retracted into the outer cylinder 80, the stop 72 of the cap 70 bears against the inclined surface 34" when the stop 31" comes in contact with the stop 72. The stop 31" is thus retracted radially inward. Namely, the switch member 30" can be retracted into the outer cylinder 80 without moving to a specific angular position.

According to the above description, a reliable dual-mode manual air pump is provided, and operation therefor is simple and easy. Namely, only rotation of the switch member is required for switching between high-pressure inflation and high-volume inflation. Potential breakage of the thinner piston rod encountered during the use of conventional two-cylinder manual hand air pump is avoided.

Although the invention has been explained in relation to its preferred embodiment, it is to be understood that many other possible modifications and variations can be made without departing from the spirit and scope of the invention as hereinafter claimed.

What is claimed is:

1. A manual air pump comprising:

an outer cylinder (80) comprising a chamber (83) therein and including a first end and a second end, a head (82) provided to the second end of the outer cylinder, the head including an outlet passage (91) communicated with the chamber (83) for supplying air to an object to be inflated, an inner cylinder (50) reciprocatingly mounted in the outer cylinder and including a longitudinal hole (55), the inner cylinder including a first end distal to the head and a second end adjacent to the head, an outer piston (60) being attached to the second end of the inner cylinder (50) to move therewith, the outer piston including a passage (63) that is intercommunicated between the longitudinal hole (55) of the inner cylinder (50) and the outlet passage (91) of the head (82), a piston rod (10) reciprocatingly mounted in longitudinal hole (55) of the inner cylinder (50) and having a first end and a second end, an inner piston (40) being attached to the second end of the piston rod to move therewith, a handle (11) secured to the first end of the piston rod (10) to move therewith, and a switch member (30) rotatably mounted to the first end of the outer cylinder (80) and around the first end of the inner cylinder (50), the switch member being rotatable between a first position for securing the piston rod (10) to the inner cylinder (50) to allow joint sliding movement of the piston rod and the inner cylinder such that reciprocating movement of the handle (11) causes high volume/low pressure inflation and a second position for securing the inner cylinder (50) to the outer cylinder (80) and for disengaging the piston rod (10) from the inner cylinder (50) such that reciprocating movement of the handle (11) causes low volume/high pressure inflation.

2. The manual air pump as claimed in claim 1, wherein the second end of the inner cylinder (50) includes an inner threaded section (54) and wherein the outer piston (60)

includes a stud (62) for engaging with the inner threaded section of the inner cylinder.

3. The manual air pump as claimed in claim 1, wherein the second end of the piston rod (10) includes a screw hole (15) and wherein the inner piston (40) includes a stud (42) for engaging with the screw hole of the piston rod.

4. The manual air pump as claimed in claim 1, wherein an inner periphery defining the longitudinal hole (55) of the inner cylinder (50) includes a longitudinal guide strip (52), and wherein the piston rod (10) includes a longitudinal groove (14) defined in an outer periphery thereof for receiving the longitudinal guide strip, thereby preventing relative rotational movement between the inner cylinder (50) and the piston rod (10).

5. The manual air pump as claimed in claim 1, further comprising a cap (70) securely mounted to the first end of the outer cylinder (80), the cap including a longitudinal hole (75) through which the inner cylinder (50) extends, the cap further including a first stop (72), the switch member (30) including a second stop (32) and a skirt (34), a disc (12) being formed between the first end of the piston rod (10) and the handle (11) and including a third stop (13), wherein:

when the switch member is in the first position, the second stop (32) of the switch member (30) is in overlapped relationship with the third stop (13) of the disc (12), thereby allowing joint sliding movement of the piston rod (10) and the inner cylinder (50), and the skirt (34) is not in overlapped relationship with the first stop (72) of the cap (70), thereby allowing joint longitudinal movement of the inner cylinder (50) and the piston rod (10) relative to the outer cylinder (80), and when the switch member is in the second position, the second stop (32) of the switch member (30) is not in overlapped relationship with the third stop (13) of the disc (12), thereby allowing longitudinal sliding movement of the piston rod (10) relative to the inner cylinder (50), and the skirt (34) is in overlapped relationship with the first stop (72) of the cap (70), thereby preventing longitudinal movement of the inner cylinder (50) relative to the outer cylinder (80).

6. The manual air pump as claimed in claim 5, wherein an inner periphery defining the longitudinal hole (75) of the cap (70) includes a longitudinal groove (73), and wherein the inner cylinder (50) includes a longitudinal guide strip (53) formed on an outer periphery thereof and guided in the longitudinal groove (73), thereby preventing relative rotational movement between the inner cylinder (50) and the cap (70).

7. The manual air pump as claimed in claim 5, wherein the switch member is manually movable to a third position in which the second stop (32) of the switch member (30) is in overlapped relationship with the third stop (13) of the disc (12), the skirt (34) is in overlapped relationship with the first stop (72) of the cap (70), thereby preventing longitudinal movement of the inner cylinder (50) and the piston rod (10) relative to the outer cylinder (80).

8. The manual air pump as claimed in claim 5, further comprising an engaging disc (20) securely mounted around the first end of the inner cylinder (10) and received in the switch member (30), the engaging disc (20) including a recessed portion (23) defined in a side thereof, a peripheral wall defining the recessed portion (23) including an inner threading (22) for engaging with an outer threading (51) on the first end of the inner cylinder (50).

9. The manual air pump as claimed in claim 1, further comprising a cap (70) securely mounted to the first end of the outer cylinder (80), the cap including a longitudinal hole (75) through which the inner cylinder (50) extends, the cap further including a first stop (72), the switch member (30') including a groove (32') and a second stop (31') partially received in the groove (32'), an elastic element (33') being mounted in the groove (32') for biasing the second stop (31') radially outward, a disc (12) being formed between the first end of the piston rod (10) and the handle (11) and including a third stop (13), wherein:

when the switch member is in the first position, the second stop (31') of the switch member (30') is in overlapped relationship with the third stop (13) of the disc (12), thereby allowing joint sliding movement of the piston rod (10) and the inner cylinder (50), and the skirt (34) is not in overlapped relationship with the first stop (72) of the cap (70), thereby allowing joint longitudinal movement of the inner cylinder (50) and the piston rod (10) relative to the outer cylinder (80), and when the switch member is in the second position, the second stop (31 ') of the switch member (30') is not in overlapped relationship with the third stop (13) of the disc (12), thereby allowing longitudinal sliding movement of the piston rod (10) relative to the inner cylinder (50), and the skirt (34) is in overlapped relationship with the first stop (72) of the cap (70), thereby preventing longitudinal movement of the inner cylinder (50) relative to the outer cylinder (80).

10. The manual air pump as claimed in claim 9, wherein the second stop (31') includes an inclined surface (34') in an underside thereof.

11. The manual air pump as claimed in claim 1, further comprising a cap (70) securely mounted to the first end of the outer cylinder (80), the cap including a longitudinal hole (75) through which the inner cylinder (50) extends, the cap further including a first stop (72), the switch member (30") including a slot (31") to thereby define a second stop (32") in an end edge thereof, a disc (12) being formed between the first end of the piston rod (10) and the handle (11) and including a third stop (13), wherein:

when the switch member is in the first position, the second stop (32") of the switch member (30") is in overlapped relationship with the third stop (13) of the disc (12), thereby allowing joint sliding movement of the piston rod (10) and the inner cylinder (50), and the skirt (34) is not in overlapped relationship with the first stop (72) of the cap (70), thereby allowing joint longitudinal movement of the inner cylinder (50) and the piston rod (10) relative to the outer cylinder (80), and when the switch member is in the second position, the second stop (32") of the switch member (30") is not in overlapped relationship with the third stop (13) of the disc (12), thereby allowing longitudinal sliding movement of the piston rod (10) relative to the inner cylinder (50), and the skirt (34) is in overlapped relationship with the first stop (72) of the cap (70), thereby preventing longitudinal movement of the inner cylinder (50) relative to the outer cylinder (80).

12. The manual air pump as claimed in claim 11, wherein the second stop (32") includes an inclined surface (33") in an underside thereof.

* * * * *